United States Patent [19]

Stich

[11] Patent Number: 4,622,513

[45] Date of Patent: Nov. 11, 1986

[54] GATING OF THE THYRISTORS IN AN ARCLESS TAP CHANGING REGULATOR

[75] Inventor: Frederick A. Stich, Milwaukee, Wis.

[73] Assignee: Siemens Energy & Automation, Inc., Atlanta, Ga.

[21] Appl. No.: 655,923

[22] Filed: Sep. 28, 1984

[51] Int. Cl.[4] ..... G05F 1/26

[52] U.S. Cl. ..... 323/343; 361/8; 361/9; 361/13; 323/260; 323/261; 323/344

[58] Field of Search ..... 361/5, 6, 8, 9, 13; 323/255-263, 340-344

[56] References Cited

U.S. PATENT DOCUMENTS

| | | | |
|---|---|---|---|
| 4,130,789 | 7/1977 | Neumann | 323/43.5 |
| 4,201,938 | 10/1978 | Neumann | 361/13 |
| 4,301,489 | 12/1979 | Stich | 361/9 |
| 4,363,060 | 12/1981 | Stich | 361/8 |

FOREIGN PATENT DOCUMENTS

| | | | |
|---|---|---|---|
| 2457807 | 6/1976 | Fed. Rep. of Germany | 323/258 |

*Primary Examiner*—William H. Beha, Jr.
*Attorney, Agent, or Firm*—F. W. Powers; J. L. James

[57] ABSTRACT

A voltage regulator using electronic control of two static switch circuits to permit tap changing without arcing at the switched electrical contacts, without interrupting the load current, and without inducing sizable circulating currents. As a mechanical drive connects a new tap to the auxiliary winding, current through the new winding is blocked by an auxiliary static switch. The drive next opens the main switch delivering current to the load. The opening of the main switch immediately allows the main static switch circuit to "turn on" to prevent arcing and load interruption until the next current zero. The main static switch control senses no current passing through the main switch and ceases gating, and therefore conduction, of the main static switch. Since neither the main static switch nor the auxiliary static switch is conducting current from the auxiliary winding, the load voltage begins dropping and the voltage across the auxiliary static switch begins rising. When a threshold across the auxiliary static switch is sensed by the overvoltage circuit, the auxiliary static switch control gates the auxiliary static switch "on" connecting the new tap voltage to the load without interruption. As the auxiliary static switch carries the load current, the main switch may be switched to the new tap connection arclessly. After the new tap is connected, the main switch closes. Any arcing of bouncing main contacts is prevented by a main static switch half cycle conduction shunting.

4 Claims, 9 Drawing Figures

GATING OF THE THYRISTORS IN AN ARCLESS TAP CHANGING REGULATOR

BACKGROUND OF THE INVENTION

This invention relates to voltage control systems of the tap changing type, and more particularly to improved gating for suppression of arcing and circulating current as taps are changed.

A step voltage regulator is an autotransformer provided with load ratio control equipment for regulating the voltage on the feeder or bus to which it is connected. A typical step voltage regulator may have a one hundred percent exciting winding in shunt with the line on the source side and normally maintains the voltage on the load side within a desired voltage bandwidth by a 10% tapped buck/boost winding in series with the line. The series winding has taps connected to the stationary contacts of a tap changer dial switch having a pair of rotatable tap selectors driven by a reversible motor into sequential engagement with the taps and usually provides the ability to change the effective turns ratio from input to output plus or minus 10% in 32 steps of $\frac{5}{8}$% voltage increments. In early designs, the rotatable selectors are connected through collector rings to the opposite sides of a bridging center-tapped autotransformer reactor, termed a preventive autotransformer, permitting transition from one tap position to another without interrupting the load current. The high impedence of the preventive autotransformer limits circulating current when the tap selectors bridge adjacent taps to a safe value and reduces burning and erosion of the tap changer contacts. It also provides a voltage midway between that of the physical tap to thereby provide twice the number of voltage steps. However, such a preventive autotransformer has continuous energy losses in operation and is bulky and expensive to construct.

The tap change regulator shown in U.S. Pat. No. 4,130,789 eliminates such preventive autotransformer and also prevents arcing at the tap changer selector contacts by providing a half-tap voltage auxiliary winding in an auxiliary switch which permits a selector contact to step arclessly to an open-circuited new tap, and then connect the selector contact in series with the auxiliary winding in a current-limiting inductor and the load at reduced voltage to effect a tap change without interruption of the load circuit. U.S. Pat. No. 4,201,938 discloses a regulator that prevents arcing, without utilizing a preventive autotransformer, by a shunt static switch circuit electronically ensuring that the main load current is interrupted at current zero. However, there is still some arcing at the auxiliary choke switching contacts, and there are still sizable circulating current losses in the regulator during tap changes.

U.S. Pat. No. 4,301,489 and U.S. Pat. No. 4,363,060, which are hereby incorporated by reference, disclose two methods for preventing arcing at the auxiliary switching contact by replacing the auxiliary current limiting choke with an auxiliary static switch circuit which by a combination of electronic and electromechanical control circuits ensure that the load current and the circulating auxiliary current are both interrupted at current zero. The regulators disclosed in these two patents provide good arcless regulation; however, there are still sizable power losses in the circulating current during tap changes and the electro-mechanical control signal switches must be installed and precisely aligned for proper timing with respect to the rest of the motor driven switches. Further, electro-mechanical switches are subject to wear and mechanical failures. Such would lead to mis-timing of the control signals and the result would be arcing and accelerated wear of the load and auxiliary switch contacts.

The tap change regulators shown in U.S. Pat. No. 4,301,489 and U.S. Pat. No. 4,363,060 use electromechanical switches for main current switching control, partly because of the stringent requirements for a totally electronic control system. An electro-mechanical control switch only senses for the main contactor position to determine if the main current switch control is required and thus is independent of the main current flowing to the load. An electronic control circuit instead of sensing the position of the main contactor, senses for zero rms main current as an indication that main current switching control is required, and thus must operate independently of main current whenever it is in the operating range between 16 amperes to 2000 amperes rms.

It is an object of this invention to provide an improved tap changer voltage regulator which has control circuits that are completely electrical in design to prevent the expense of installation and precise alignment of electro-mechanical switches during assembly and maintenance.

It is a further object of this invention to provide a more reliable arcless tap changer regulator by eliminating electro-mechanical control components for gating the static switch shunting the main switch and the static switch shunting the auxiliary circuit.

It is a further object of this invention to provide a main current static switch gating circuit that is independent of the main current over the entire operating current range.

Another object of this invention is to reduce the circulating current and the power losses associated with the circulating current during tap changing to less than one-half cycle of the alternating current fundamental frequency in duration.

SUMMARY OF THE INVENTION

A tap change voltage regulator is provided which has multi-tapped electrical winding and a fractional tap voltage auxiliary winding inductively linked together. A pair of tap selectors are provided to sequentially engage the regulator taps. One of the tap selectors is coupled to one end of the auxiliary winding. An auxiliary switch switches between one of two stationary contacts: either the contact connected to the other end of the auxiliary winding, or the contact connected to the second tap selector to supply voltage. A main current switch is connected between the output of the auxiliary switch and the output terminal where one end of the load is connected. A static switch circuit is connected to provide a shunt around the main current switch to the output terminal. A mechanical drive operates the auxiliary switch to its positions. A tap-changing auxiliary shunt circuit connected between the end of the auxiliary winding which is not connected to the tap selector and the output terminal provides an alternate path about the auxiliary switch and the main current switch. The auxiliary shunt circuit includes a static switch circuit, similar to the one shunting the main current switch, and a current limiting resistor. A static switch control circuit gates the static switch circuit shunting the main current switch "on" whenever the main current switch contacts open and the instantaneous current immediately prior to the contacts opening is not essentially zero therethrough, thereby shunting the load current around the opening contacts until the next alternating current zero and preventing arcing at the main current switch contacts. An auxiliary static switch control circuit gates the auxiliary static switch circuit "on" whenever the voltage across the non-selector end of the auxiliary winding and the output terminal exceeds the threshhold which is set slightly above the maximum of a tap voltage difference so the voltage will only exist when the main current switch is opened and the main current shunt static switching circuit is "off". This allows the auxiliary switch to change positions without arcing. As the main current switch contacts begin closing, the main current switch static switch circuit is again gated "on" by the control circuit and thereby prevents arcing during closure. This regulator therefore uses static control circuits sensing current in one application and sensing voltage in another and thus completely eliminates the need for position-sensing control switches which are expensive to assemble and subject to wear and misalignment.

The combination of the auxiliary shunt static switch control circuit gating only when load current is essentially interrupted, and the main current static switch control circuit gating its shunt switch "on" only during the half cycle of main contact opening or closing, results in a regulator in which circulating current between the auxiliary circuit and the tap winding can only flow during part of the half cycle when the main current switch is closing, thereby preventing sizable circulating current and its associated energy losses.

The current sensing control circuit utilizes a current transformer that is saturable at high currents and a saturation control circuit such that the current induced in the current transformer initially increases with increasing load current and then starts to level off to a constant for any further increases in load current thereby providing for an electrical static switching control circuit that is essentially independent of load current level over the operating range.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DETAILED DESCRIPTION OF THE INVENTION

Figure 1:
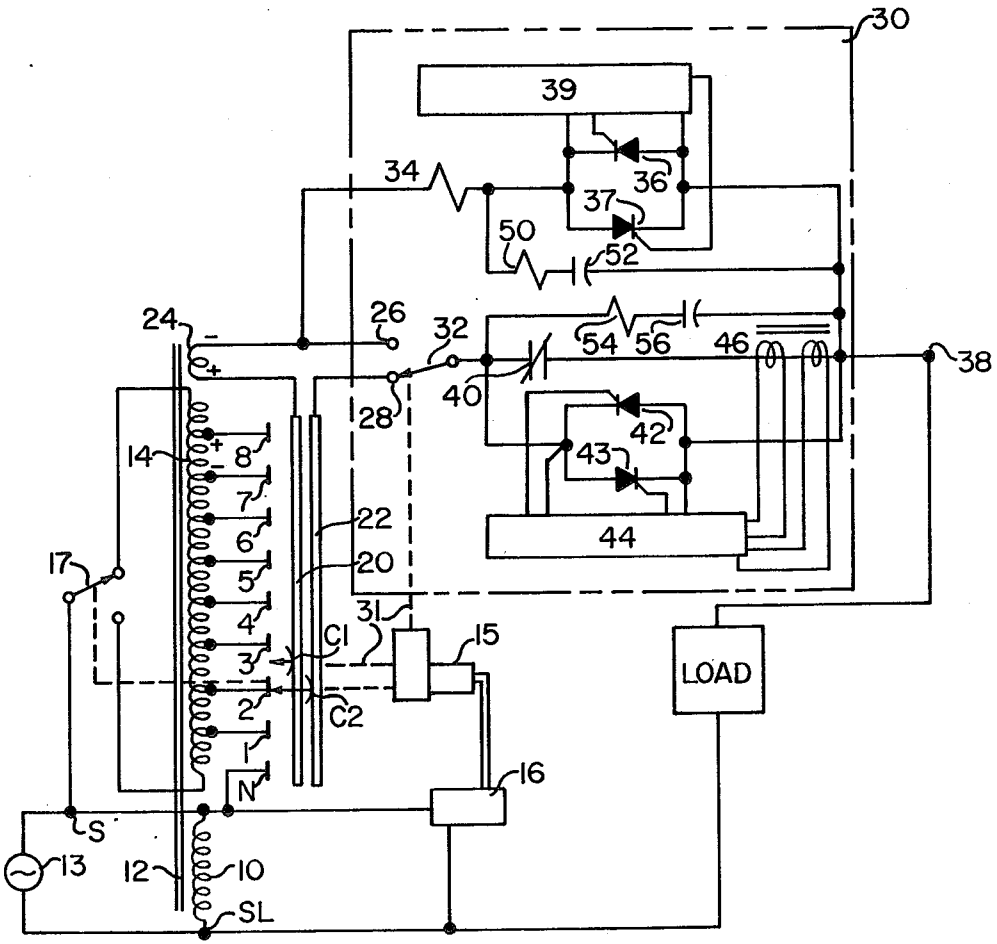
FIG. 1 is a schematic circuit diagram of the preferred embodiment of the invention in quiescent state.

A step voltage regulator embodying the invention illustrated in FIG. 1 has a one hundred percent exciting winding 10 which inductively links a magnetic core 12 and is connected across the regulator S and SL bushings which are adapted to be connected to an alternating current source 13, such as a power line to be regulated. The regulator also has a ten percent series winding 14 which inductively links magnetic core 12 and is connected in series with the power line and is provided with a plurality of taps 1–8 of a tap changer dial switch, which contacts are preferably arranged in a circle and driven to the desired position by motor 15 and conventional motor control 16.

One side of winding 10 is connected to a stationary neutral tap N and is also connected to the one end of the series winding 14 by an automatic, mechanically-operated reversing switch 17 which reverses polarity of series winding 14 so that it may be connected in bucking or boosting relation with shunt winding 10, thereby doubling the range of the tap changer system. Two movable tap selectors C1 and C2 are provided. The tap selectors are preferably rotatable and sequentially engage the stationary taps 1–8 and N. Tap selector C2 is in engagement with a tap in the quiescent state of the tap changer switch in FIG. 1, and tap selectors C1 and C2 are in bridging relation with adjacent stationary contacts or on the same stationary contacts only during a tap change. Tap selectors C1 and C2 slidably engage collectors 20 and 22 respectively which are conventionally slip rings in concentric relation with the circle of stationary taps 1–8 and N.

A half-tap voltage auxiliary winding 24 inductively linking magnetic core 12 has approximately one-half as many turns as the number of turns between adjacent taps of series winding 14 so that auxiliary winding 24 derives a full-step (half-tap) voltage. Preferably, auxiliary winding 24 is wound to oppose the voltage of series winding 14, but in alternative embodiments auxiliary winding 24 may be in aiding relation to winding 14. One end of auxiliary winding 24 is connected to collector 20, and the other end is connected to contact 26 and to the shunt circuit of an auxiliary switching system generally designated 30 and bounded by a broken line. A first stationary contact 28 is connected to collector 22. The auxiliary switch system is preferably operated synchronously with tap changer switch selector contacts C1 and C2 by a common drive mechanism schematically represented at 31.

Auxiliary system 30 includes auxiliary switch 32 which engages either of stationary contacts 26 and 28. As is conventional in tap changer mechanisms of the general type illustrated, a cam-end-follower drive mechanism or alternatively a Scotch yoke drive is coupled to selector switch 32 which causes it to operate in the proper sequence relative to tap selector C1 and C2. Stationary contact 26 is connected through a resistor 34, a first static switch circuit comprised of a pair of inverse parallel SCR's 36 and 37, and the output terminal 38 to a load. A first gating control 39 supplies gating current to SCR's 36 and 37 as auxiliary switch 32 moves toward contact 26 as sensed by the overvoltage circuitry portion of gating control 39.

Auxiliary switch 32 is connected to the load through a normally closed main current switch 40 operated in a conventional manner by the drive mechanism. A second pair of SCR's 42 and 43, connected in inverse parallel are connected in shunt about switch 40 so that load current flows throuoh the selector C2, through the auxiliary switch 32 and either through contactor 40 or SCR's 42 and 43. A second gating circuit 44 regulates the gating of SCR's 42 and 43 and receives inputs from current transformer 46.

Gating circuits 39 and 44 are specially designed to provide all electronic sensing for the control of SCR's 36 and 37 and SCR's 42 and 43. Gating circuit 39 is an overvoltage circuit and gating circuit 44 is saturable current transformer circuit.

Figure 2:
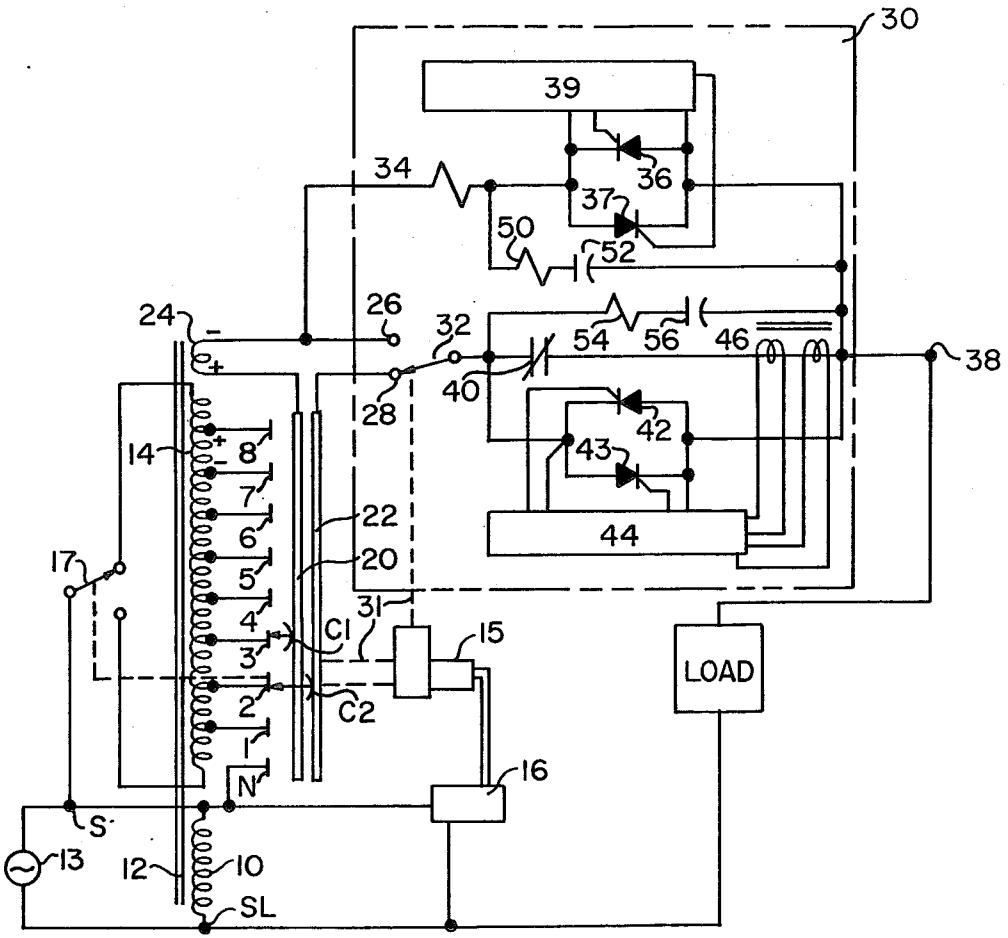
FIGS. 2–7 show the apparatus of FIG. 1 in sequential states of operation.
Figure 9:
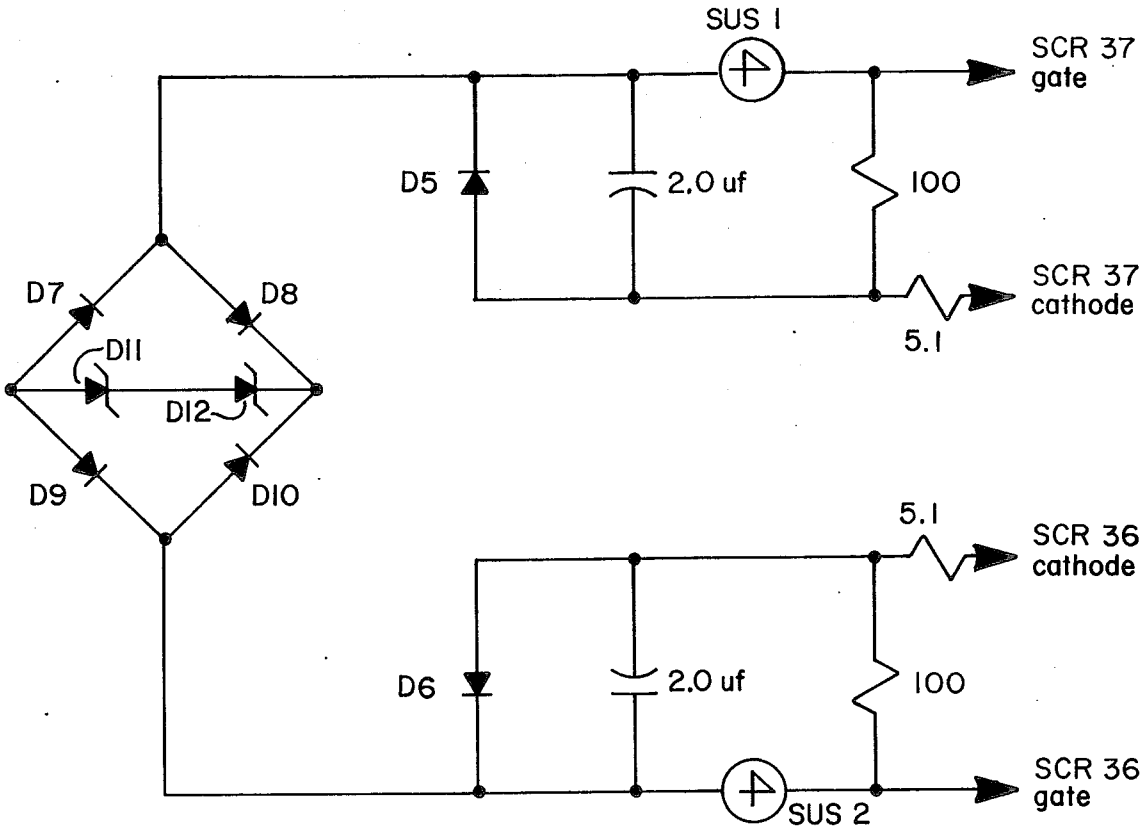
FIG. 9 is a schematic diagram of the preferred embodiment of the improved gating circuit for the thyristor static switch shunting the auxiliary switch.

Referring to FIG. 9, and FIG. 2, it can be seen that the cathode of SCR 37 is connected directly to the output terminal 38 where the load is also connected and that SCR 36 cathode is connected through a low ohmage resistor 34 to the auxiliary winding. This circuit 39 senses for an overvoltage condition, that is a voltage greater than would exist between taps, between SCR 36 cathode and SCR 37 cathode.

The overvoltage circuit as can be seen in FIG. 9 is symmetrical. Full wave diode bridge D7–D10 has two symmetric nodes, that is, the common point of D7 and D8, and the common point of D9 and D10, and two non-symmetric nodes, that is, the common point of D8 and D10, and the common point of D7 and D9. The D8–D10 node is conventionally termed "positive" and the D7–D9 node is conventionally termed "negative" because when any voltage is impressed across the symmetric nodes of the full wave bridge, the mathematical absolute value of that voltage will be provided between the positive and negative nodes of the bridge. Since the operation of the circuit is symmetrical, only the response to the positive half cycle of the a.c. voltage will be described, and those skilled in the art will recognize the similar response on the negative half cycle.

Figure 3:
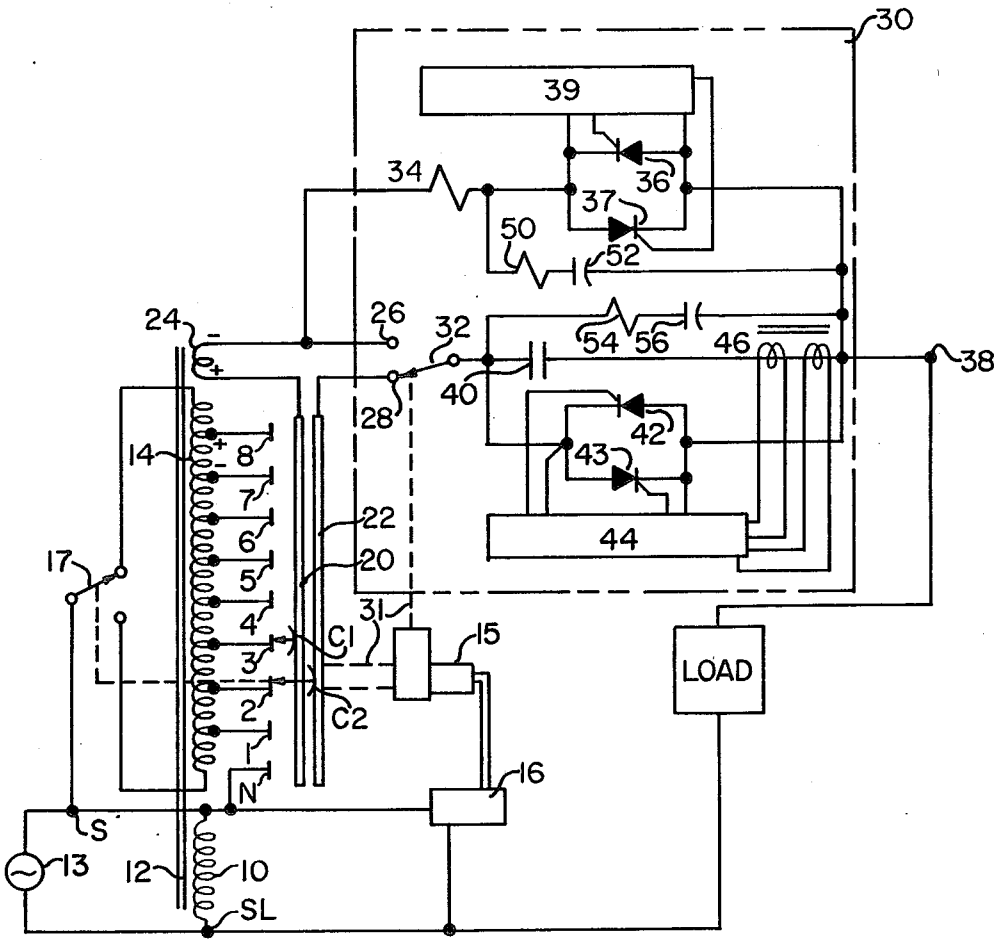

When C1 is on a tap and the current flow from collector 22 to output terminal 38 is interrupted as shown in FIG. 3, the voltage across the load will drop and thereby an overvoltage condition will exist across SCR 36 cathode and SCR 37 cathode. As positive voltage begins at zero crossover and begins to build up across windings 10 and 14, diodes D6, D7 and D10 will be forward biased and diodes D5, D8 and D9 will be reversed biased, the current will be blocked from flowing by zener diode series D11 and D12 until the combined zener voltage of D11 and D12 is exceeded. As soon as the rising voltage exceeds the combined zener diode voltages of D11 and D12, then voltage begins to build up across the preferably 2.0 micro-farad capacitor from essentially zero and charges essentially instantaneously with the voltage passed by the zener diodes, and also builds up across silicon unilateral switch SUS 1. When the voltage across SUS 1 reaches its threshold, it changes state from a very high impedence to a very low impedence, thereby gating a current pulse which is the sum of the current out of the capacitor and the current through the zener diodes into the gate of SCR 37. Once SCR 37 is gated "on", the overload condition goes away as current flowing through SCR 37 to the load builds up the potential drop across the load and thereby removes the overvoltage condition for the remainder of this half cycle. The preferably 5.1 ohm resistors in the overvoltage circuit are for surge suppression to the gates of the SCR's and the preferably 100 ohm resistors are noise suppressors to absorb stray noise power and thereby prevent noise from inadvertently gating the SCR's 36 and 37.

Figure 8:
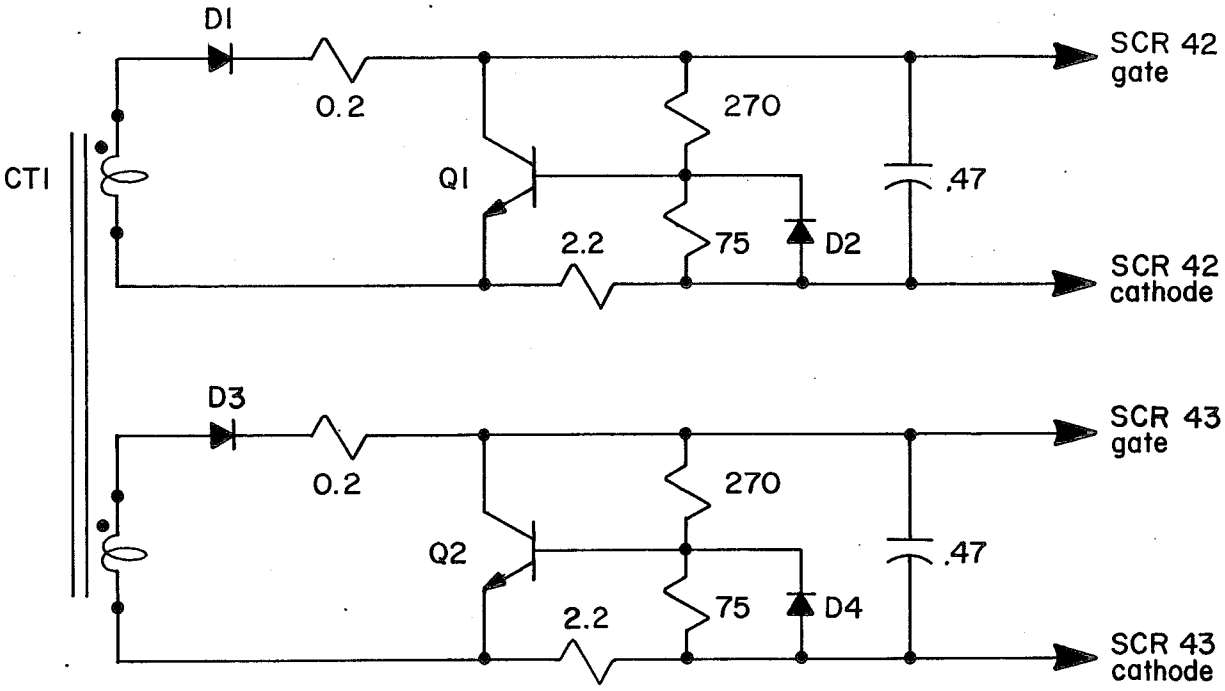
FIG. 8 is a schematic diagram of the preferred embodiment of the improved gating circuit for the thyristor static switch shunting the main current switch.

Referring to FIG. 8 and FIG. 2, it can be seen that in the preferred embodiment the main current static switch control 44 uses as sensory inputs the signals from current transformer 46 which has two secondary windings. The secondaries are connected in opposite phase relationship to two identical gating circuits. This arrangement means that SCR 43 can only be gated during the positive half cycle of the main current and SCR 42 can only be gated during the negative half cycle of the main current. Since the gating circuits for SCR's 42 and 43 are identical, only the operation of the gating circuit of SCR 43 will be described and those skilled in the art can then understand the working of the other half of the circuit.

Beginning at the zero crossover of the alternating current, the current flows positively through main current switch 40 and through current transformer 46 inducing current in the secondary winding. Positive current is conducted by forward bias diode D3 and through a control resistor of 0.2 ohms. The current will charge up the preferably 470 nano-farad capacitor, which is almost instantaneously since this capacitor is primarily for noise suppression, until the turn on voltage of Q2 base-emitter junction is reached. At this time, Q2 acting in concert with the 270 ohm resistor, the 75 ohm resistor and the 2.2 ohm resistor will become a voltage and current regulating circuit to provide control of the gating current and voltage to the gate and cathode terminals of SCR 43 without exceeding the gate power and current ratings thereof. Diode D4 is to bypass the 75 ohm resistor during heavy current conditions in order to drive the base of Q2 even harder and thereby regulate the current to the gate during surge currents. At very heavy main current conditions, to ease the regulation range requirements of Q2, the current transformer 46 is designed to controllably saturate, thereby giving little or no increase in secondary with further increases in primary current. The preferably 0.2 ohm resistor provides a voltage drop at high currents to control the saturation current. This gives the circuit an operating main current range of 15 amperes to over 2000 amperes continuously and surge currents in excess of 20,000 amperes.

From FIG. 2, it can be seen that gating circuit 44 will gate SCR's 42 and 43 whenever current in the operating range flows through the main current switch; however, since the main current switch 40 has a lower impedence that the SCR's 42 and 43, the SCR's will not actually turn on in response to the gating signals. However, when the main current switch starts to open or starts to close, the virtual short across the SCR's 42 and 43 will be removed and the SCR that is being gated in that half cycle will then conduct. Since the gating current is derived from the main current, when the main current switch opens gating circuit 44 ceases operation and the static switching circuit ceases conduction at the next current zero crossing.

FIGS. 2–5 illustrate successive conditions of the elements of the circuit during tap changes. FIG. 2 selector C2 is on tap 2, selector C1 is now on tap 3 and selector switch 32 still engages stationary contact 28. The linkage 31 advances selector C1 to its new position.

The next step in the operation of the apparatus is illustrated in FIG. 3 wherein main current switch 40 is open. SCR's 42 and 43 are enabled by control 44 and shunt current about switch 40 so that no arcing occurs. As described above, when main switch 40 opens, there is no current through current transformer 46 and gating control 44 ceases to gate SCR's 42 and 43 and therefore conduction of SCR's 42 or 43 ceases at this point. Now an overvoltage condition will occur between output terminal 38 and auxiliary winding contact 26, causing gating control circuit 39 to turn on SCR's 36 and 37 and load current will be drawn through tap selector C1. At this time, no current is flowing through selector switch 32.

Figure 4:
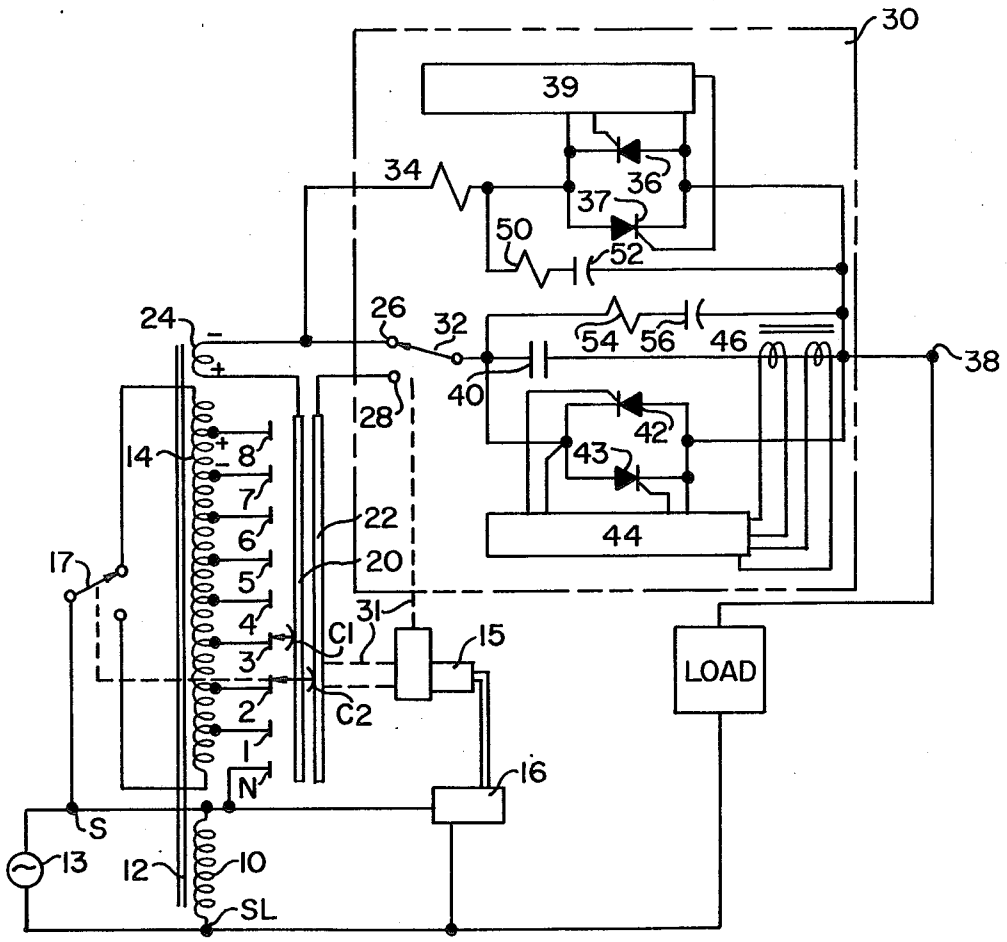

As shown in FIG. 4, switch 32 then engages stationary contact 26. Disengagement from stationary contact 28 is arcless, as there is no current flow through the switch. Further, due to the open state of switch 40 and the non-conductive state of SCR's 42 and 43, there is no tendency for switch 32 to arc as it approaches stationary contact 26.

Figure 5:
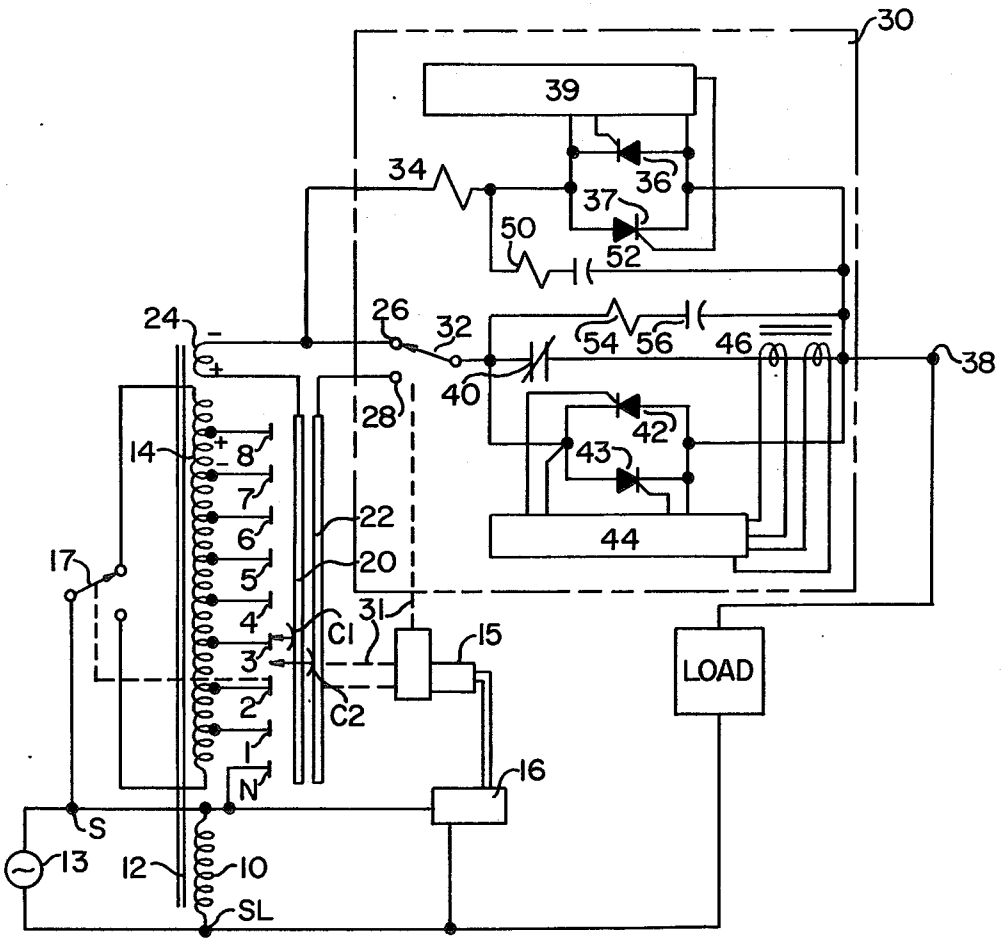

As shown in FIG. 5, switch 40 is thereafter closed whereupon current flows from tap 3 and through winding 24, stationary contact 26, switch 32 and main current switch 40. Selector switch 32 and main current switch 40 effectively short circuit the upper circuit including SCR's 36 and 37 and current limiting resistor 34. As switch 40 provides current to the load, the overvoltage condition will cease and SCR's 36 or 37 will cease conduction immediately. Tap selector C2 may now be arclessly disengaged from tap 2 as shown, or may be left on the latter.

Figure 6:
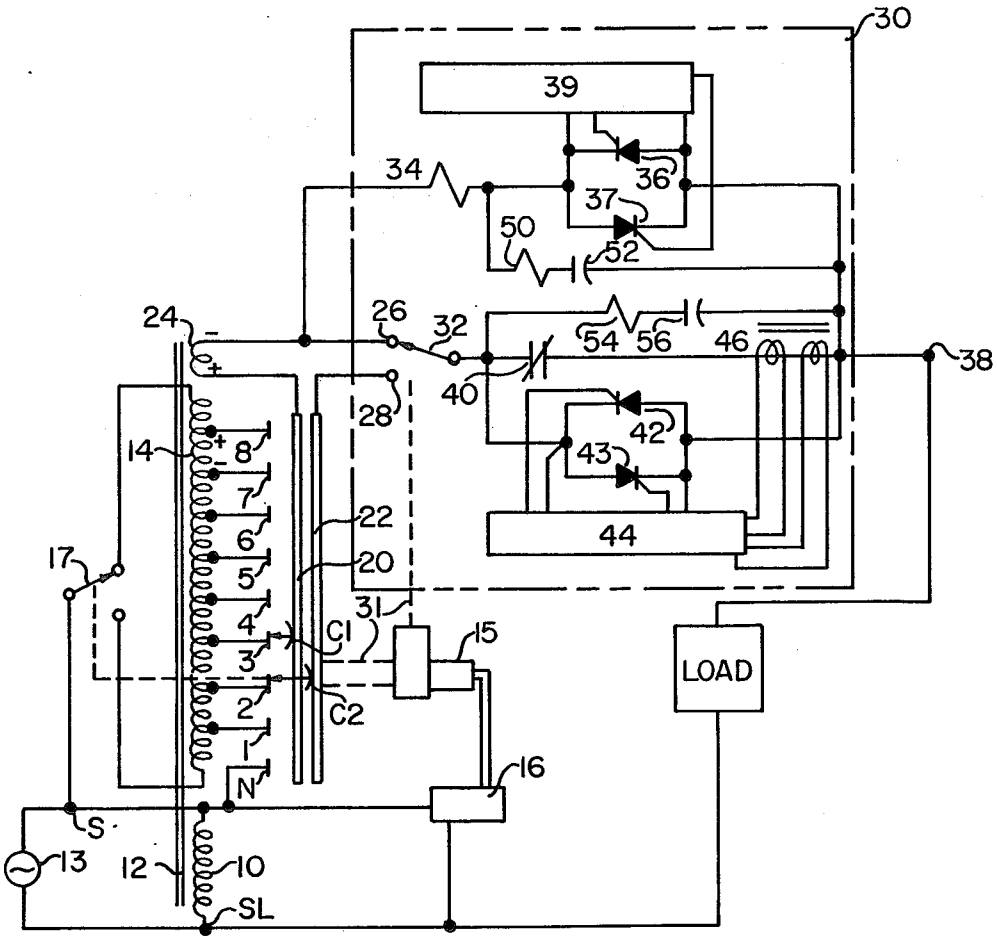
Figure 7:
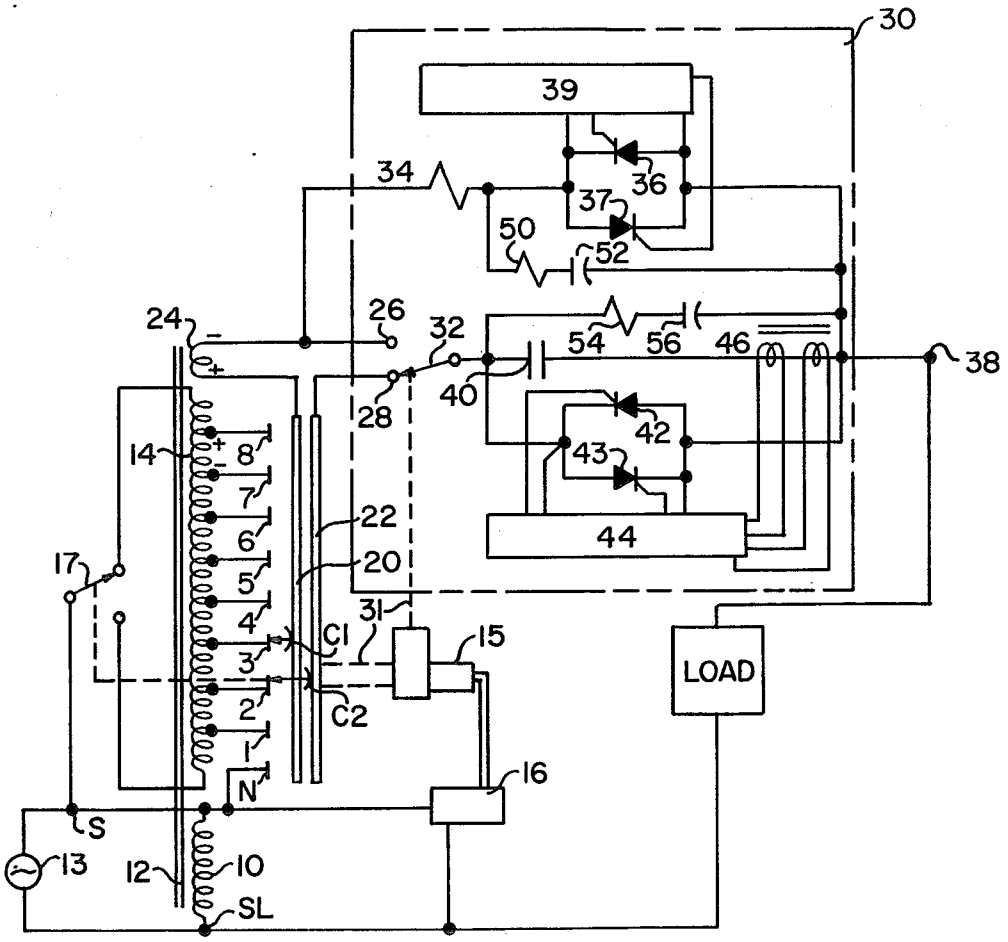

Consider now the case in which a lowering, rather than a raising, of voltage is sought. As shown in FIG. 6, selector C2 is brought into contact with (or may already be in contact with) the next tap below that engaged by selector C1, in this instance, tap 2. Movement by mechanism 31 opens main switch 40. As before, gating control circuit 44 gates either SCR 42 or SCR 43 on completing the half cycle in which switch 40 opened allowing it to open arclessly. Gating circuit 44 and SCR's 42 and 43 cease activity at the next current zero. After SCR's 42 and 43 become non-conducting, an overvoltage condition is incurred between output terminal 38 and auxiliary contact 26 stimulating gating circuit 39 to gate SCR's 36 and 37 into conduction. As shown in FIG. 7, switch 32 may now be disengaged from stationary contact 26 by the operating mechanism 31 and brought into engagement with stationary contact 28. No arcing occurs when switch 32 disengages contact 26, inasmuch as switch 40 and SCR's 42 and 43 are non-conducting. After switch 32 has engaged contact 28 and preferably after a short time delay to allow contact bounce to cease, main current switch 40 is closed. Gating circuit 44 will sense closure of switch 40 and will gate SCR's 43 or 42 "on" to prevent arcing during initial closure and any arcing contact bounce of closure. Circulating current will flow between taps 3 and 2, but the removal of the overvoltage condition when switch 40 closes removes the gating signal from control 39 and the SCR's 36 and 37 become non-conducting at the next zero crossing thereby limiting the circulating current to less than half a cycle in duration. The auxiliary shunt path is now inactive and all the load current flows through the newly engaged tap 2, selector switch 32, and main current switch 40.

It will now be recognized that there has been disclosed an improved arcless tap changer circuit which is extremely simple, economical and reliable in design. Although it will be noted that the discontinuities or "step" voltages encountered in "lower" tap voltages are greater than those in the "raise" mode, it has been determined that the step voltage thus produced is well within the requirements of electric utilities. Further, it will be evident from the foregoing descriptions that certain aspects of the invention are not limited to the particular details of the example illustrated, and it is therefore contemplated that other modifications or applications will occur to those skilled in the art. It is accordingly intended that the appended claim shall cover all such modifications and applications as do not depart from the true spirit and scope of the invention.

What is claimed as new and desired to be secured by Letters Patent of the United States is:

1. In a tap change voltage regulator having a tapped electricl winding with a plurality of taps, a part-tap voltage auxiliary winding inductively linked to said tapped winding, a pair of tap selectors adapted to sequentially engage said taps, one of said tap selectors being coupled to one side of said auxiliary winding, an auxiliary switch having first and second stationary contacts coupled respectively to the other side of said auxiliary winding, an auxiliary switch having first and second stationary contacts coupled respectively to the other side of said auxiliary winding and to the second of said tap selectors; an output terminal; a main current switch coupled between said auxiliary switch and said output terminal; first static switching means connected in shunt about said main current switch; drive means for sequentially operating said tap selectors and said auxiliary switch; a tap changing shunt circuit coupled between said other side of said auxiliary winding and said output terminal thereby to provide an alternate current path about said auxiliary switch and said main current switch, said auxiliary shunt circuit having a second static switching means, and a current limiting resistor, the improvement comprising:

a controlled saturation current transformer gating circuit including:

a saturable current transformer inductively coupled to the current flowing through the main current switch, having a first secondary winding and a second secondary winding:

a first and second rectifier diodes having their anodes connected respectively to the positive lead of said first secondary winding and the negative lead of said second secondary winding, whereby said first and second rectifier diodes conduct on alternate half cycles;

a first saturation controlling impedence connected to the cathode of said first rectifier diode, and a second saturation controlling the impedence connected to the cathode of the second rectifier diode, said saturation controlling impedences having a value selected whereby the voltage drop of each impedence as current increases cause said current transformer to saturate and change the effective turns ratio of said current transformer such that the secondary currents increase at a slower rate than the primary current;

a first and second voltage and current clamping means connected respectively between said first saturation controlling impedence and said second saturating controlling impedance and the other end of said second secondary winding on their input side and having the outside sides of said first and second voltage and current clamping means connected respectively to said first static switching means; providing gating current continuously whenever current flows through the current transformer primarily such that the first static switching means is continuously able to carry the main current to the load whenever said main current switch opens, and continues to carry the main current to the load until the next alternating current zero, thereby allowing the main current switch to open arclessly; and an overvoltage gating circuit including:

one or more zener diodes connected in series with all zener cathodes oriented in the direction of positive voltage;

a plurality of bridge diodes connected in a standard full wave bridge rectifier configuration, having said one or more zener diodes series cathode end connected to the positive terminal of said full wave bridge and the one or more zener diodes series anode end connected to the negative terminal of said full wave bridge;

a first and second steering diodes, the first steering diode having its cathode connected to a first terminal of said full wave bridge having also an anode and a cathode of said bridge diodes connected to said first terminal, the second steering diode having its cathode connected to a second terminal of said full wave bridge having also an anode and cathode of said bridge diodes connected to said second terminal;

a first and second capacitors, the first capacitor having one lead electrically connecting to the anode of said first steering diode and the other lead electrically connecting to the cathode of said first sterring diode, the second capacitor having one lead electrically to the anode of said second steering diode and the other lead electrically connecting to the cathode of said second steering diode;

a first and second silicon unilateral switches having the input of the first silicon unilateral switch electrically connected to the cathode of said first steering diode and the output of said first silicon unilateral switch electrically connected to the gate of a first auxiliary static switch thyristor, and having the input of the second silicon unilateral switch electrically connected to the gate of a second auxiliary static switch thyristor;

a first and second current limiting resistors having one end of the first current limiting resistor electrically connected to the cathode of said first auxiliary static switch thyristor and the other end of the first current limiting resistor electrically connected to the anode of said first steering diode, and having one end of the second current limiting resistor electrically connected to the cathode of said second auxiliary static switch thyristor and the other end of the second current limiting resistor electrically connected to the anode of said second steering diode; and a first and second noise suppression resistors having one end of the first noise suppression resistor electrically connected to the gate of said first auxiliary static switch thyristor and the other end of said first noise suppression resistor electrically connected to the anode end of said first steering diode, and having one end of the second noise suppression resistor electrically connected to the gate of said second auxiliary static switch thyristor and the other end of said second noise suppression resistor electrically connected to the anode end of said second steering diode;

said overvoltage gating circuit constantly sensing for an overvoltage condition across said auxiliary static switch thyristors indicating a need to gate each of said auxiliary static switch thyristors to its respective conducting condition to carry the load current during an arcless tap change of the voltage regulator.

2. The improvement as defined in claim 1, wherein:

said first and second saturation controlling impedences are both two-tenths of an ohm resistors; and said first and second voltage and current clamping means are active circuits each comprising: a high current transistor having its collector connected to the respective saturation controlling impedence and its emitter connected to the other end of respective said current transformer;

a two and two-tenths ohm resistor having one end attached to the transistor emitter as a current limiter;

a two hundred and seventy ohm resistor connected between the transistor collector and transistor base to provide base current to turn the transistor on and clamp the voltage across the transistor, a seventy-five ohm resistor connected from the transistor base to the other end of said two and two-tenths ohm current limiting resistor, providing in concert with said current limiting resistor feedback to stabilize the maximum voltage and current clamp by the transistor so as to regulate power dissipated in the gate of static switch to a safe level;

a clamping diode having its cathode connected to the said transistor base and its anode connected to said other end of the two and two-tenths ohm resistor providing a low impedence for base drive current derived from the current feedback; and a capacitor having one end connected to said transistor collector and the other end connected to said clamping diode anode to eliminate triggering by high-frequency disturbances.

3. The tap change voltage regulator as set forth in claim 1, wherein the auxiliary shunt circuit current limiting resistor is lower in resistance than regulators without his improvement, thereby lowering voltage drops and power losses during tap changes; because of the limitation of the circulating current to less than one-half current cycle.

4. An overvoltage gating circuit for use in the control of a tap change voltage regulator, comprising:

one or more zener diodes connected in series with all zener cathodes oriented in the direction of positive voltage;

a plurality of diodes connected in a standard full wave bridge configuration, having said one or more zener diodes series cathode end connected to the positive terminal of said full wave bridge and the one or more zener diodes series anode end connected to the negative terminal of said full wave bridge;

a first and second steering diodes, the first steering diode having its cathode connected to a first terminal of said full wave bridge having also an anode and a cathode of said bridge diodes connected to said first terminal, the second steering diode having its cathode connected to a second terminal of said full wave bridge having also an anode and cathode of said bridge diodes connected to said second terminal;

a first and second capacitors, the first capacitor having one lead electrically connecting to the anode of said first steering diode and the other lead electrically connecting to the cathode of said first steering diode, the second capacitor having one lead electrically to the anode of said second steering diode and the other lead electrically connecting to the cathode of said second steering diode;

a first and second silicon unilateral switches having the input of the first silicon unilateral switch electrically connected to the cathode of said first steering diode and the output of said first silicon unilateral switch electrically connected to the gate of a first auxiliary static switch thyristor, and having the input of the second silicon unilateral switch electrically connected to the cathode of said second steering diode and the output of said, second silicon unilateral switch electrically connected to the gate of a second auxiliary static switch thryistor;

a first and second current limiting resistors having one end of the first current limiting resistor electrically connected to the cathode of said first auxiliary static switch thyristor and the other end of the first current limiting resistor electrically connected to the anode of said first steering diode, and having one end of the second current limiting resistor electrically connected to the cathode of said second auxiliary static switch thyristor and the other end of the second current limiting resistor electrically connected to the anode of said second steering diode; and a first and second noise suppression resistors having one end of the first noise suppression resistor electrically connected to the gate of said first auxiliary static switch thyristor and the other end of said first noise suppression resistor electrically connected to the anode end of said first steering diode, and having one end of the second noise suppression resistor electrically connected to the gate of said second auxiliary static switch thyristor and the other end of said second noise suppression resistor electrically connected to the anode end of said second steering diode;

said overvoltage gating circuit constantly sensing for an overvoltage condition across said auxiliary static switch thyristors indicating a need to gate each of said auxiliary static switch thyristors to its respective conducting condition to carry the load current during an arcless tap change of the voltage regulator.

* * * * *